US006857343B1

(12) United States Patent
Easterbrooks et al.

(10) Patent No.: US 6,857,343 B1
(45) Date of Patent: Feb. 22, 2005

(54) SPRING-LOADED THREADED FASTENER HOLDER

(75) Inventors: Christina Easterbrooks, Plainville, MA (US); Jose Correia, New Bedford, MA (US); Amadeu Mendes, New Bedford, MA (US)

(73) Assignee: Codman & Shurtleff, Inc., Raynham, MA (US)

( * ) Notice: Subject to any disclaimer, the term of this patent is extended or adjusted under 35 U.S.C. 154(b) by 0 days.

(21) Appl. No.: 10/674,561

(22) Filed: Sep. 30, 2003

(51) Int. Cl.[7] ..... B25B 23/10
(52) U.S. Cl. ..... 81/452; 606/104
(58) Field of Search ..... 81/451–458; 606/104

(56) References Cited

U.S. PATENT DOCUMENTS

| | | | | | |
|---|---|---|---|---|---|
| 728,830 | A | | 5/1903 | Astryke | |
| 881,298 | A | | 3/1908 | Chappel | |
| 942,742 | A | | 12/1909 | Presson | |
| 1,450,203 | A | * | 4/1923 | De Brown | 81/452 |
| 1,522,927 | A | * | 1/1925 | Wickstrom et al. | 81/453 |
| 1,549,413 | A | | 8/1925 | Greet | |
| 1,712,196 | A | | 5/1929 | Burger et al. | |
| 2,302,691 | A | * | 11/1942 | Green | 81/453 |
| 2,526,211 | A | | 10/1950 | Erickson | |
| 2,621,767 | A | * | 12/1952 | McDevitt | 81/453 |
| 2,762,409 | A | * | 9/1956 | Brasen | 81/453 |
| 2,902,071 | A | | 9/1959 | La Pointe et al. | |
| 2,933,114 | A | * | 4/1960 | Bystrom | 81/453 |
| 2,952,285 | A | * | 9/1960 | Roosli | 81/453 |
| 2,954,809 | A | | 10/1960 | Loewy | |
| 3,901,298 | A | * | 8/1975 | Eby | 81/455 |
| 4,719,828 | A | | 1/1988 | Corsetti | |
| 5,667,513 | A | * | 9/1997 | Torrie et al. | 606/104 |
| 5,791,207 | A | * | 8/1998 | Ahdoot | 81/452 |
| 6,116,125 | A | | 9/2000 | McLeod | |

* cited by examiner

*Primary Examiner*—Debra S. Meislin

(57) ABSTRACT

A threaded fastener holder holds a screw in place and then automatically disengages from the screw and withdraws axially in the proximal direction to permit the user to continue inserting the screw without interruption. The threaded fastener holder has a shaft having a distal end for selectively engaging with a head of a threaded fastener. An inner sleeve surrounds at least a portion of the shaft, and is axially movable with respect to the shaft. The inner sleeve has a plurality of spring fingers disposed at its distal end, each of which has a distal end that is radially movable so as to be selectively engageable with the head of the threaded fastener. A first end of a spring is fixed with respect to the inner sleeve. The second end of the spring is fixed with respect to the shaft. In the rest position, the distal end of the plurality of spring fingers is axially spaced from the distal end of the shaft.

11 Claims, 2 Drawing Sheets

SPRING-LOADED THREADED FASTENER HOLDER

BACKGROUND OF THE INVENTION

1. Field of the Invention

The present invention relates to a spring loaded threaded fastener holder. More specifically, the present invention relates to a spring loaded threaded fastener holder that is used as an accessory of a screwdriver for use in retaining a screw in position at the distal end of a screwdriver.

2. Discussion of the Related Art

In this specification, the term "screwdriver" is taken to incorporate, but not be limited to, a posi-drive screwdriver, an alien key driver, a phillips screwdriver, a cross-point screwdriver, a flat head screwdriver, a star point screwdriver and a socket head screwdriver, which can be manually operated or which can be driven by a power tool or the like.

In order to urge a screw into a surface, the screw must be held in an operative position, usually by hand, whilst a screwdriver is held in the other hand and engaged with the screw head and the screw is axially rotated until it catches sufficiently in the surface, whereupon the hand used to hold the screw can be removed. This is often disadvantageous as the screw may be too small to grip effectively, or the work area may be cramped making it difficult or impossible to hold the screw whilst screwing it in, and the need for using two hands often precludes a user from using his or her hands to steady himself or hold other items.

To alleviate these problems, magnetized screwdriver tips are known. Magnetized screwdriver tips have the disadvantage in that they can sometimes be insufficiently magnetized and a screw will fall off the end of the screwdriver before being fastened in place. The screw may also magnetically attach itself to the shaft of the screwdriver instead of the end of the screwdriver tip, requiring that the screw be re-positioned correctly at the end of the head. The magnetized screwdriver head may also magnetize the screw itself, which may be disadvantageous in certain circumstances.

Putty has also been employed to retain screws on the tip of a screwdriver. The putty becomes dirty, dries out and becomes ineffective. The putty can also fall off the screwdriver, which can be problematic if it falls into sensitive equipment. Additionally, if the screw is to be inserted into a bone, putty can not be used as it is typically disadvantageous to add unnecessary foreign objects into the body.

Thus, there is a need in the art for a threaded fastener holder that will hold the screw in place at the distal end of the screwdriver, and then automatically disengages from the screw and withdraws axially in the proximal direction to permit the user to continue inserting the screw without interruption.

SUMMARY OF THE INVENTION

The present invention accomplishes this need with a threaded fastener holder having a shaft having a distal end for selectively engaging with a head of a threaded fastener. A handle is connected to a proximal end of the shaft. An inner sleeve surrounds at least a portion of the shaft. The inner sleeve is axially movable with respect to the shaft. The inner sleeve has a plurality of spring fingers disposed at a distal end of the inner sleeve. The plurality of spring fingers each has a distal end that are radially movable so as to be selectively engageable with the head of a threaded fastener. A spring has a first end and a second end. The first end of the spring is fixed with respect to the inner sleeve. The second end of the spring is fixed with respect to the shaft, wherein, in the rest position, the distal end of the plurality of spring fingers is axially spaced from the distal end of the shaft.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENT

Figure 1:
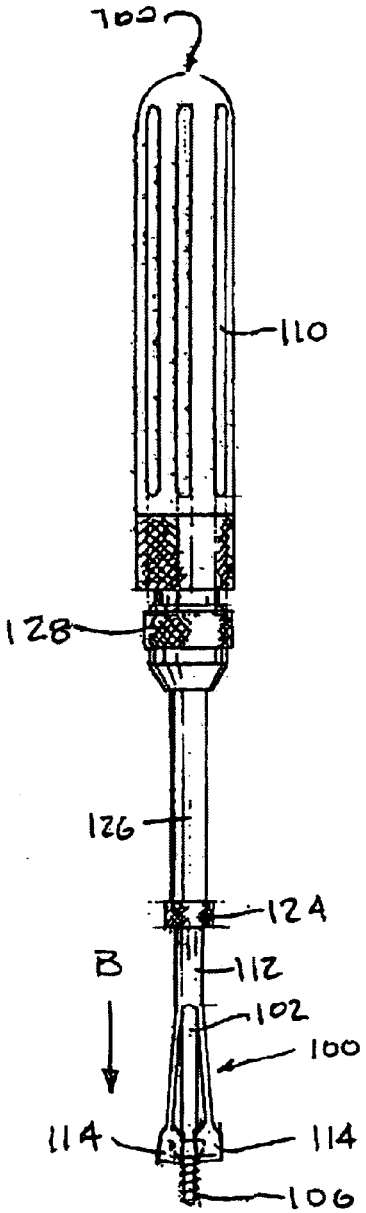
FIG. 1 is a front view of the threaded fastener holder in accordance with the present invention.

Referring now to FIGS. 1–5, a threaded fastener holder 100 in accordance with the present invention is illustrated. The threaded fastener holder 100 includes a shaft 102 having a distal end 104 for selectively engaging with a head of a threaded fastener 106, and a proximal end 108. A handle 110 is connected to the proximal end 108 of shaft 102.

An inner sleeve 112 surrounds at least a portion of shaft 102. Inner sleeve 112 is axially movable with respect to shaft 102. Inner sleeve 112 has a plurality of spring fingers 114 disposed at a distal end of inner sleeve 112. Each of the spring fingers 114 has a distal end that is radially movable with respect to the longitudinal axis of the shaft so as to be selectively engageable with the head of threaded fastener 106.

A spring 116 has a first end 118 and a second end 120. The first end 118 of spring 116 is fixed with respect to inner sleeve 112. More specifically, first end 118 is fixedly connected to an enlarged proximal head portion 122 of inner sleeve 112. The second end 120 of spring 116 is indirectly fixed with respect to shaft 102. More specifically, second end 120 is fixedly connected to an end cap 124, which is fixedly connected to an outer sleeve 126. Outer sleeve 126 is fixedly connected to a second nut 128, which is fixedly connected to handle 110. Outer sleeve 126 surrounds at least a portion of inner sleeve 112. Handle 110 is fixedly connected to shaft 102.

Figure 2:
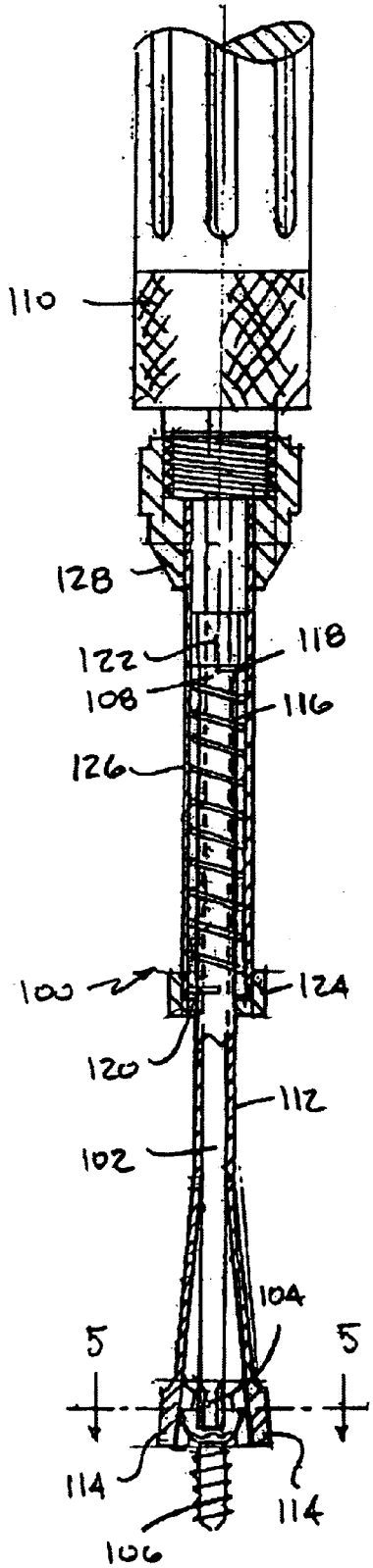
FIG. 2 is a front view of the threaded fastener holder of FIG. 1 shown engaged with a threaded fastener.
Figure 3:
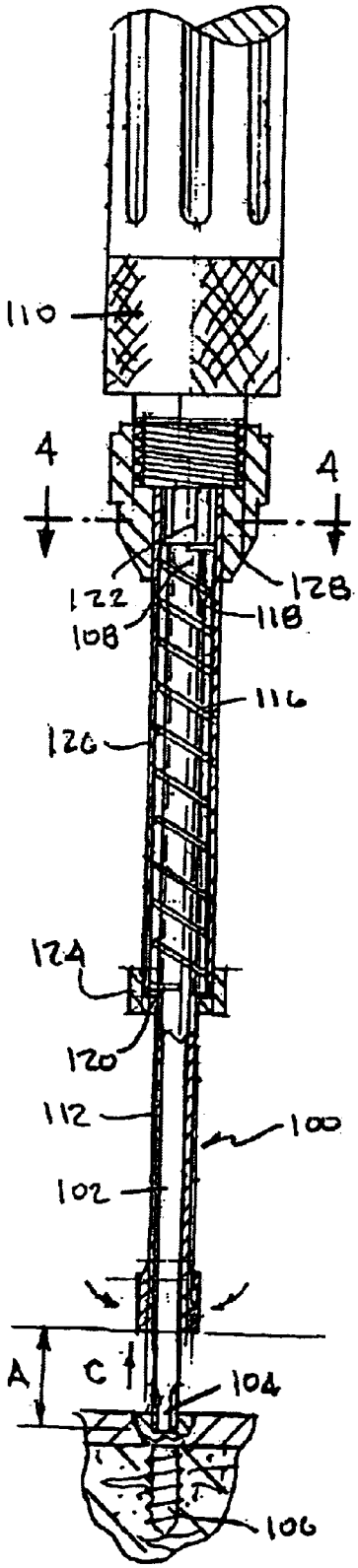
FIG. 3 is a front view of the threaded fastener holder of FIG. 1 shown with the threaded fastener holder automatically moved into an axially proximal position.
Figure 4:
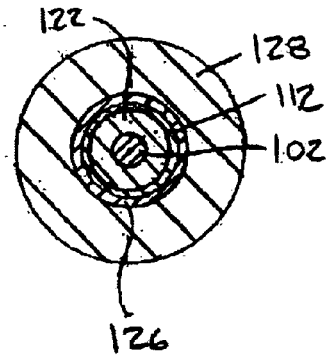
FIG. 4 is a cross-sectional view taken along line 4—4 of FIG. 3 and looking in the direction of the arrows.
Figure 5:
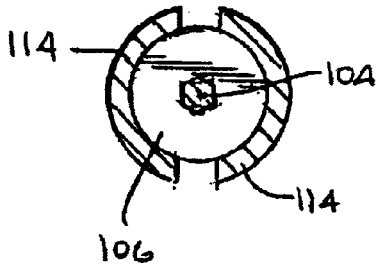
FIG. 5 is a cross-sectional view taken along line 5—5 of FIG. 2 and looking in the direction of the arrows.

In a rest position, the distal end of the spring fingers 114 is axially spaced from the distal end 104 of shaft 102 by distance A, as illustrated in FIG. 3. When the spring fingers engage the head of a threaded fastener 106, the distal end of the spring fingers 114 is approximately axially aligned with the distal end 104 of shaft 102, as illustrated in FIG. 2.

In use, the threaded fastener holder 100 is held, preferably by handle 110 with one hand, and the user can grasp the inner sleeve 112 with their other hand and slide the inner sleeve, including the plurality of fingers 114, axially in the distal direction B, from the position illustrated in FIGS. 1 and 2 to the position illustrated in FIG. 3, thereby placing spring 116 under tension. During this process the user can connect the fingers 114 to the head of a threaded fastener 106. The tool can then be used in a manner know to those skilled in the art to insert threaded fastener 106 into a bone. Once the threaded fastener is sufficiently inserted into the bone, the fingers will engage with either the bone, or a fastening plate 20 which engagement automatically causes the fingers 114 to disengage from the head of the threaded fastener 106. Once the fingers 114 are disengaged from the threaded fastener 106, the tension placed on spring will cause the inner sleeve 112 to move axially in the proximal direction C from the position illustrated in FIGS. 1 and 2 to the normal or rest position illustrated in FIG. 3.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A threaded fastener holder comprising:

a shaft having a distal end for selectively engaging with a head of a threaded fastener, and a proximal end;

a handle being connected to said proximal end of said shaft;

an inner sleeve surrounding at least a portion of said shaft, said inner sleeve being axially movable with respect to said shaft, said inner sleeve having a plurality of spring fingers disposed at a distal end of said inner sleeve, said plurality of spring fingers each having a distal end that are radially movable so as to be selectively engageable with the head of a threaded fastener; and a spring having a first end and a second end, said first end of said spring being fixed with respect to said inner sleeve, said second end of said spring being fixed with respect to said shaft, wherein, in said rest position, said distal end of said plurality of spring fingers is axially spaced from said distal end of said shaft.

2. The fastener holder according to claim 1, wherein said inner sleeve has an enlarged head disposed at a proximal end of said inner sleeve.

3. The fastener holder according to claim 2, wherein said first end of said inner sleeve is fixedly connected to said enlarged head.

4. The fastener holder according to claim 1, further comprising a nut being fixedly connected to said handle.

5. The fastener holder according to claim 4, further comprising an out er sleeve being fixedly connected to said nut.

6. The fastener holder according to claim 5, wherein said outer sleeve surrounds at least a portion of said inner sleeve.

7. The fastener holder according to claim 6, further comprising an end cap being fixedly connected to said outer sleeve.

8. The fastener holder according to claim 7, wherein said outer sleeve has a proximal end and a distal end, said end cap being fixedly connected to said distal end of said outer sleeve.

9. The fastener holder according to claim 8, wherein said second end of said spring is fixedly connected to said end cap.

10. The fastener holder according to claim 9, wherein said inner sleeve has an enlarged head disposed at a proximal end of said inner sleeve.

11. A method of inserting a threaded fastener into bone with a threaded fastener holder having a shaft having a distal end for selectively engaging with a head of a threaded fastener, and a proximal end; a handle being connected to said proximal end of said shaft; an inner sleeve surrounding at least a portion of said shaft, said inner sleeve being axially movable with respect to said shaft, said inner sleeve having a plurality of spring fingers disposed at a distal end of said inner sleeve, said plurality of spring fingers each having a distal end that are radially movable so as to be selectively engageable with the head of a threaded fastener; and a spring having a first end and a second end, said first end of said spring being fixed with respect to said inner sleeve, said second end of said spring being fixed with respect to said shaft, wherein, in said rest position, said distal end of said plurality of spring fingers is axially spaced from said distal end of said shaft, said method comprising the steps of:

sliding said plurality of fingers axially in the distal direction;

connecting the head of a threaded fastener to said plurality of fingers;

inserting the threaded fastener into a bone;

automatically disengaging the plurality of hinges from the head of the threaded fastener, thereby causing said inner sleeve to move axially in the proximal direction.

* * * * *